US006676423B1

(12) United States Patent
Marowsky et al.

(10) Patent No.: US 6,676,423 B1
(45) Date of Patent: Jan. 13, 2004

(54) MODULAR ELECTRICAL CONNECTOR ASSEMBLY PROVIDING ELECTROSTATIC DISCHARGE UPON INSERTION OF A MATING CONNECTOR

(75) Inventors: Richard D. Marowsky, York, PA (US); Derek Imschweiler, Dallastown, PA (US); John Matthew Hess, Sparks, MD (US); Len Espenshade, Harrisburg, PA (US); Ronald Locati, York, PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/560,990

(22) Filed: Apr. 28, 2000

Related U.S. Application Data

(60) Provisional application No. 60/131,766, filed on Apr. 30, 1999.

(51) Int. Cl.[7] ..... H01R 13/53

(52) U.S. Cl. ..... 439/181; 439/188; 439/670; 439/673

(58) Field of Search ..... 439/181, 188, 439/670, 676

(56) References Cited

U.S. PATENT DOCUMENTS 4,457,570 A * 7/1984 Bogese, II ..... 439/347
4,460,234 A * 7/1984 Bogese ..... 439/188
4,552,423 A * 11/1985 Swengel, Jr. ..... 439/507
4,703,991 A * 11/1987 Philippson ..... 439/676
4,725,241 A * 2/1988 Bertini et al. ..... 439/188
4,895,532 A * 1/1990 Bogese, II ..... 439/507
4,978,311 A * 12/1990 Oda et al. ..... 200/51.1
5,007,851 A * 4/1991 Matsumoto ..... 439/188
5,688,141 A * 11/1997 Dullin ..... 439/188
5,736,910 A * 4/1998 Townsend et al. ..... 333/181
5,788,520 A * 8/1998 Roche ..... 200/51.1
5,944,547 A * 8/1999 Golab et al. ..... 200/51.1
6,065,985 A * 5/2000 Marshall ..... 439/188

* cited by examiner

*Primary Examiner*—P. Austin Bradley
*Assistant Examiner*—Edwin A. León
(74) *Attorney, Agent, or Firm*—Steinberg & Raskin, P.C.

(57) ABSTRACT

An electrical connector assembly adapted to be mounted on a substrate having a ground region including a jack defining a plug-receiving receptacle, at least one contact having a contact portion situated in the receptacle, a shield surrounding at least a portion of the jack and a shorting bar arranged in electrical connection with the contact(s) for discharging static charge from a plug upon its insertion into the receptacle and contact between the plug and the contact(s). The shorting bar is arranged in a channel in an outer housing part of the jack and in engagement with end portions of contacts received in slots in a comb portion of the outer housing part. The shield is adapted to be connected to the ground region of the substrate whereby the shorting bar is electrically connected to the shield. In use, prior to insertion of a mating plug into the receptacle, the end portions of the contacts engage the shorting bar and as the plug is inserted into the receptacle, static charge built up on the cable to which the plug is connected is transmitted through contacts to the shorting bar, from the shorting bar to the shield and from the shield to the ground on the printed circuit board on which the connector assembly is mounted.

8 Claims, 5 Drawing Sheets

MODULAR ELECTRICAL CONNECTOR ASSEMBLY PROVIDING ELECTROSTATIC DISCHARGE UPON INSERTION OF A MATING CONNECTOR

This application claims benefit to Provisional Application No. 60/131,766 filed Apr. 30, 1999.

FIELD OF THE INVENTION

The present invention relates generally to a modular electrical connector assembly, such as a modular jack, and more specifically to a modular jack which provides electrostatic discharge upon insertion of a mating plug so that problems arising from electrostatic discharge from the plug through the jack to the substrate on which the jack is mounted are avoided.

BACKGROUND OF THE INVENTION

Data transmission cables which are plugged into units such as hubs, routers and switches, have a tendency to build up static electric charge depending on the environment. When the electrically charged cords are plugged into a data transmission device with a mating connector assembly, such as a computer, this charge can be immediately transferred from the cord through the connector assembly and to the printed circuit board on which the connector assembly is mounted. Depending on the voltages of the electric charge involved, this charge can damage expensive circuitry on the printed circuit board.

OBJECTS AND SUMMARY OF THE INVENTION

It is an object of the present invention to provide new and improved modular connector assemblies wherein electrostatic charge on a data transmission cable being coupled to the connector is discharged and eliminated before the charge is conveyed to a substrate on which the connector assembly is mounted and thereby prevent damage to the circuitry on the substrate.

Accordingly, in order to achieve this object and others, an electrical connector assembly in accordance with the invention includes a jack defining a plug-receiving receptacle, at least one contact having a contact portion situated in the receptacle, the contact portion being electrically couplable to the substrate, and static charge discharge means arranged in electrical connection with the contact(s) for discharging static charge from a plug upon insertion into the receptacle and engagement with the contact(s). The static charge discharge means preferably include a shield surrounding at least a portion of the jack and establish a path to ground from the contact(s) to the ground region of the substrate through the shield. Thus, the plug engages the contact(s) and static charge is eliminated by the connection of the contact(s) to the ground region of the substrate.

The jack may comprise a housing including an outer housing part and an inner housing part situated at least partially in the outer housing part. The outer housing part includes a comb portion defining a plurality of slots, each slot receiving an end portion of a respective contact. The outer housing part includes a channel in communication with all of the slots and possibly extending in a direction perpendicular to a longitudinal direction of the jack. In a preferred embodiment, the static charge discharge means comprises a shorting bar arranged in the channel in engagement with the end portions of the contacts received in the slots. The shorting bar is electrically connected to the shield, e.g., directly or, in the alternative, indirectly through a connecting pin.

The contacts may be unitary contacts, each having, in addition to the contact portion, a terminal portion adapted to be connected to the substrate.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
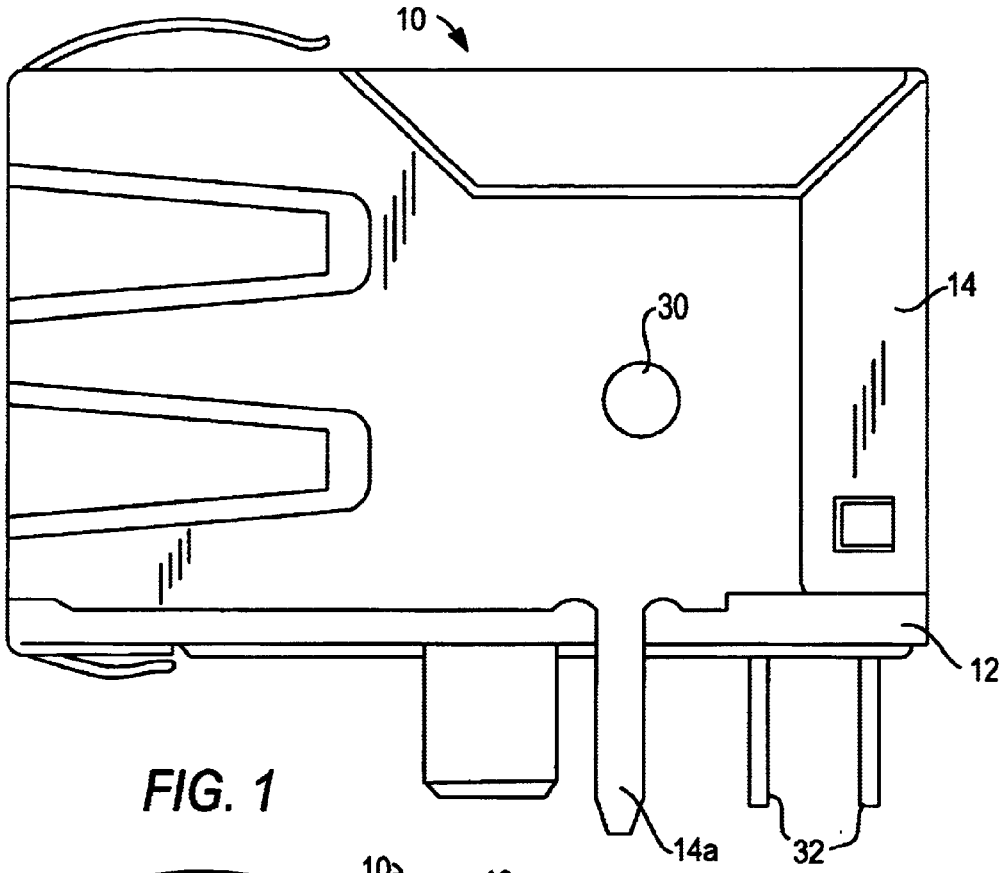
FIG. 1 is a side view of a modular electrical connector assembly in accordance with the invention.
Figure 2:
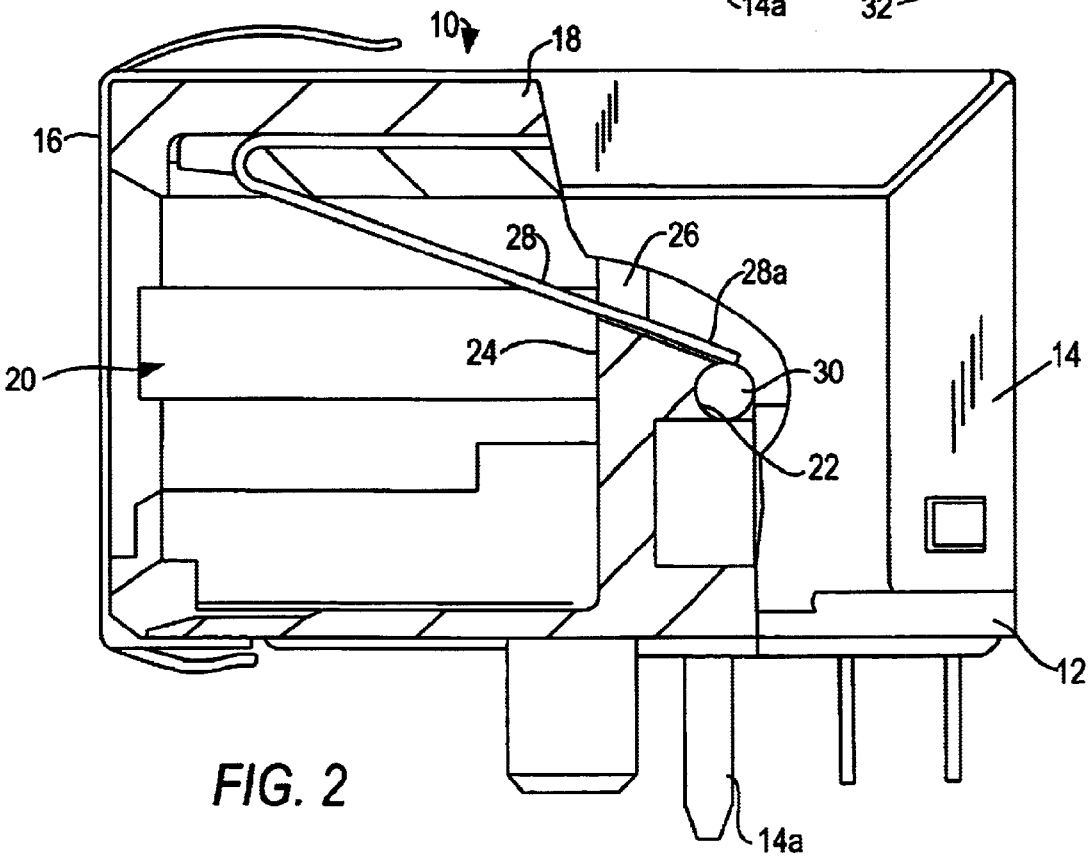
FIG. 2 is a partially broken-away view of a modular electrical connector assembly in accordance with the invention.

Referring now to the drawings wherein like reference characters designate identical or corresponding parts throughout the several views, FIG. 1 shows a side view of a modular electrical connector assembly designated 10 designed for mounting on a substrate such as a printed circuit board. The connector assembly 10 includes a jack 12 and a shield 14 surrounding at least a portion of the jack 12. Shield 14 is formed from a metallic material and includes projections 14a adapted to be connected to ground regions of a substrate, such as a printed circuit board, on which the connector assembly 10 is mounted. Jack 12 includes an outer housing part 16 and an inner housing part 18 situated in engagement with and at least partially within the outer housing part 16 to define a plug-receiving receptacle 20 (FIG. 2).

The outer and inner housing parts 16,18 may have the same general form as existing single-port modular jacks, such as those disclosed in U.S. Pat. No. 4,703,991 (assigned to the current assignee incorporated by reference herein in its entirety). However, differing from the jacks disclosed in the '991 patent, an elongate, substantially cylindrical channel 22 is formed in the comb portion 24 of the outer housing part 16 and at least one side walls of the outer housing part 16 is formed with aperture in alignment with the channel 22. The comb portion 24 also defines a plurality of substantially parallel slots 26, each slot 26 being receivable of an end portion 28a of the contact 28 situated in connection with at least the inner housing part 18. Channel 22 is open over at least a radial portion thereof to communicate with all of the slots 26.

The connector assembly 10 also includes a shorting bar 30 arranged in the channel 22. As shown in FIG. 2, the end portion 28*a* of the contacts 28 engages the shorting bar 30 in view of the construction of the contacts 28 to be biased against the lower surface of the slots 26. The comb portion 24 and channel 22 could be designed such that the end portions 28*a* of the contacts 28 contact both the shorting bar 30 and the lower surface of the slots 26.

The shorting bar 30 is constructed to extend through a side wall of the jack 12 to be connected to the shield 14 and thereby establish an electrical connection between the shorting bar 30 and the shield 14. Instead of the shorting bar 30 extending through a side wall of jack 12, the channel 22 and thus the shorting bar 30 could be designed to extend over only the slots 26 and a separate connector pin or any other electrically transmitting member provided to electrically connect the shorting bar 30 to the shield 14. As known in the art, shield 14 is electrically connected to ground on the printed circuit board on which the connector assembly 10 is mounted. Thus, the shorting bar 30 is connected to ground through the shield 14 of the connector assembly 10.

The jack 12 also includes terminal portions 32 adapted for connection to the substrate on which the connector assembly 10 is mounted and which may be part of contacts 28 or separate.

In use, prior to insertion of a mating plug into the receptacle 20, the end portions 28*a* of the contacts 28 engage the shorting bar 30 (as shown in FIG. 2). As the plug is inserted into the receptacle 20, any static charge built up on the cable to which the plug is connected is carried away as such charge is transmitted through contacts 28 to the shorting bar 30 and from the shorting bar 30 to the shield 14 and from the shield 14 to the ground on the printed circuit board on which the connector assembly 10 is mounted. This is because the contacts 28 are all in contact with shorting bar 30 when the connector assembly 10 is in an unmated state. After complete insertion of the plug into the receptacle 20 (mating), the end portions 28*a* of contacts 28 are urged out of contact with the shorting bar 30 and the shorting bar 30 does not affect data transmission between the plug and connector assembly 10. Accordingly, using the connector assembly 10 in accordance with the invention, the static charge on the cable to which the plug is attached is discharged and eliminated and is therefore not transmitted to the circuitry on the printed circuit board on which the connector assembly is mounted.

Figure 3:
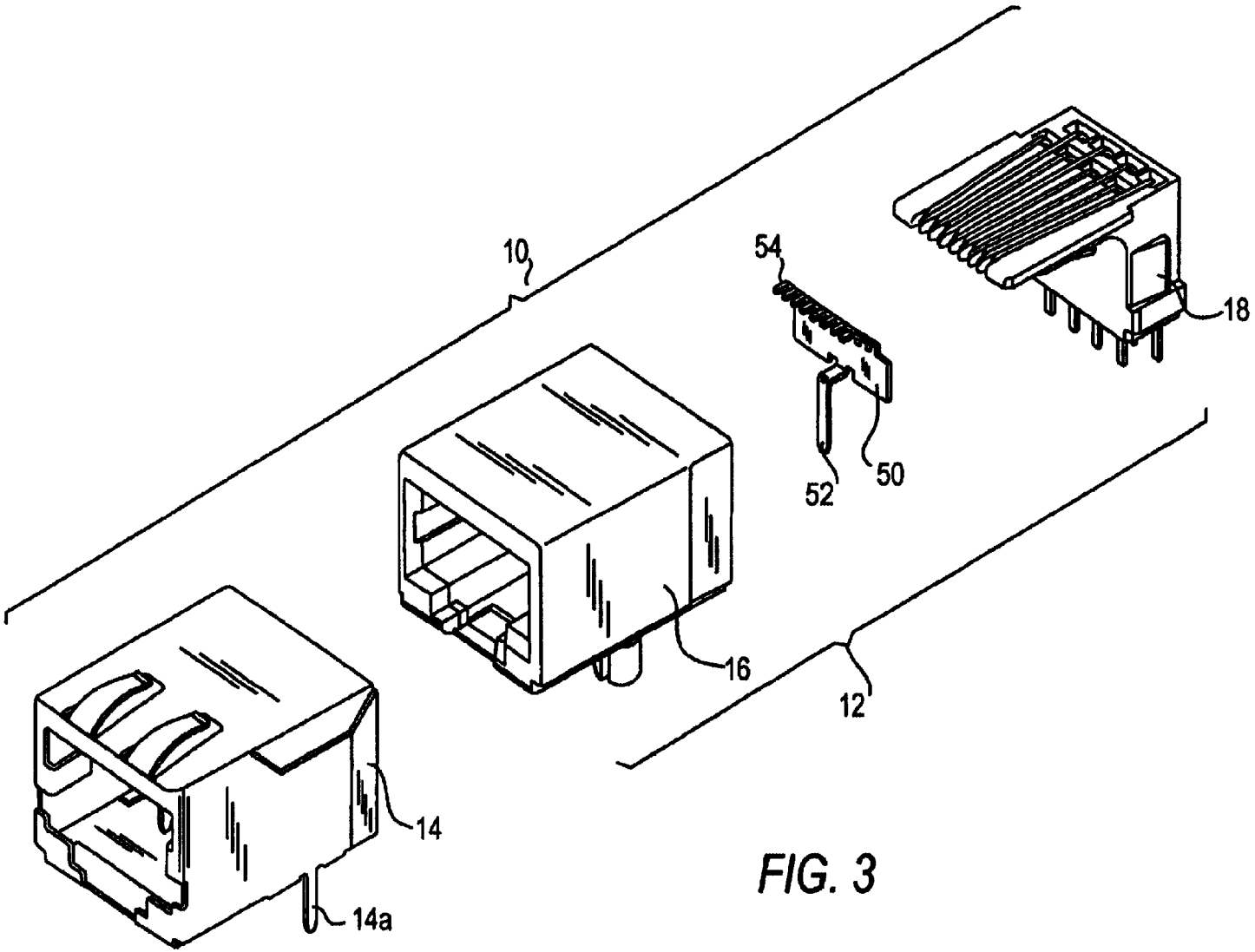
FIG. 3 is an exploded view of a modular electrical connector assembly in accordance with the invention.

In an alternate embodiment, FIG. 3 shows an exploded view of an electrical connector assembly 10 including jack 12 and shield 14 surrounding at least a portion of jack 12. Shield 14 is formed from a metallic material and includes projections 14a adapted to be connected to ground regions of a substrate, such as a printed circuit board, on which the connector assembly 10 is mounted. Jack 12 includes an outer housing part 16, an inner housing part 18 situated in engagement with and at least partially within the outer housing part 16, to define a plug-receiving receptacle 20. It also includes a shorting bar 50 situated within plug-receiving receptacle 20, between inner housing part 18 and outer housing part 16. Shorting bar 50 includes grounding projection 52 and spring-like fingers 54. Grounding projection 52 is adapted to be connected to ground regions of a substrate, such as a printed circuit board, on which the connector assembly 10 is mounted. Alternately, grounding projection 52 can be configured to electrically engage shield 14 and ground through projections 14*a* which are adapted to be connected to ground regions of a substrate.

Figure 4:
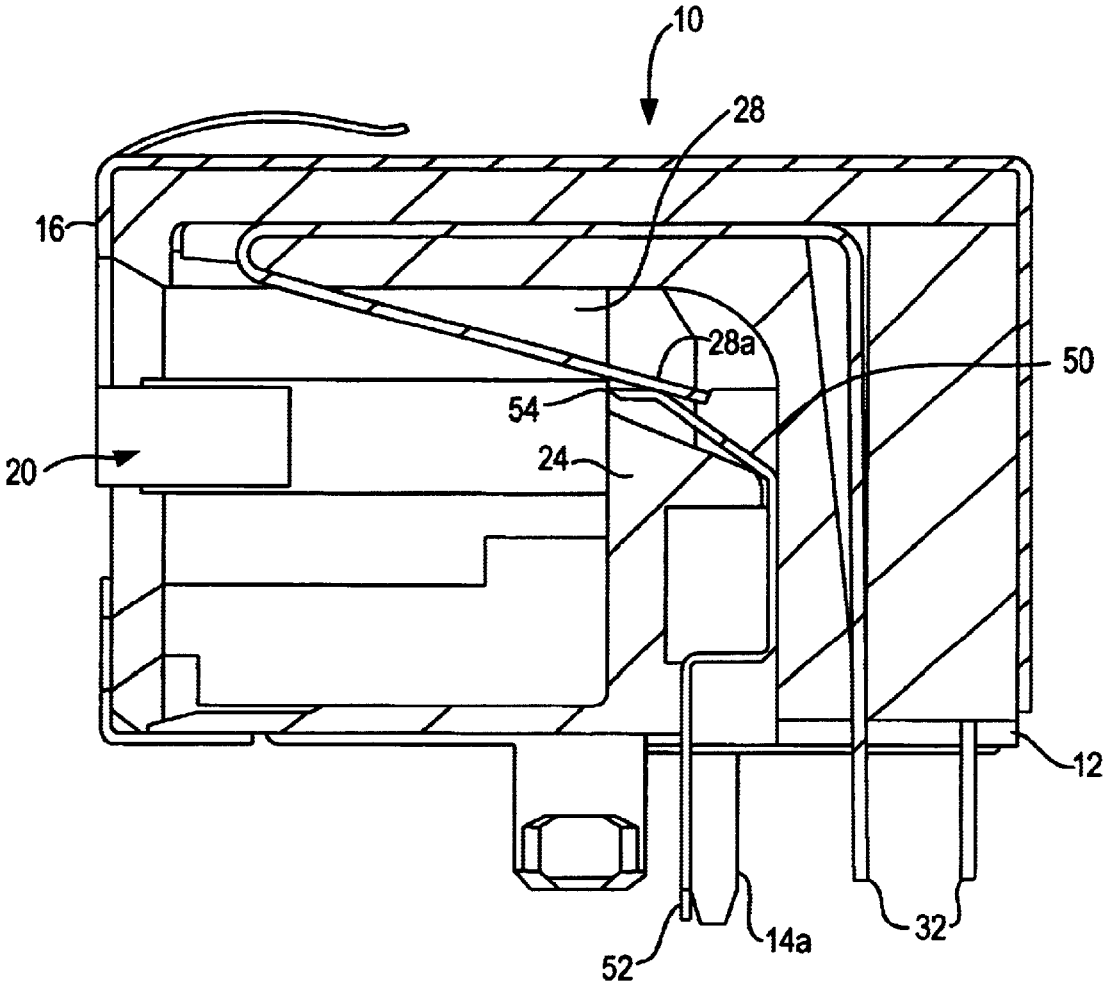
FIG. 4 is a broken-away view of a modular electrical connector assembly in accordance with the invention.

The outer and inner housing parts 16,18 may have the same general form as existing single-port modular jacks, such as those disclosed in U.S. Pat. No. 4,703,991 (assigned to the current assignee incorporated by reference herein in its entirety). However, differing from the jacks disclosed in the '991 patent, is the inclusion of the shorting bar 50 in between inner housing part 18 and outer housing part 16. The comb portion 24 also defines a plurality of substantially parallel slots 26, each slot 26 being receivable of a finger 54 of the shorting bar 50. As shown in FIG. 4, the end portions 28*a* of the contacts 28 engage the fingers 54 in view of the construction of the contacts 28 to be biased towards the lower surface of the slots 26.

The jack 12 also includes terminal portions 32 adapted for connection to the substrate on which the connector assembly 10 is mounted and which may be part of contacts 28 or separate.

Figure 5:
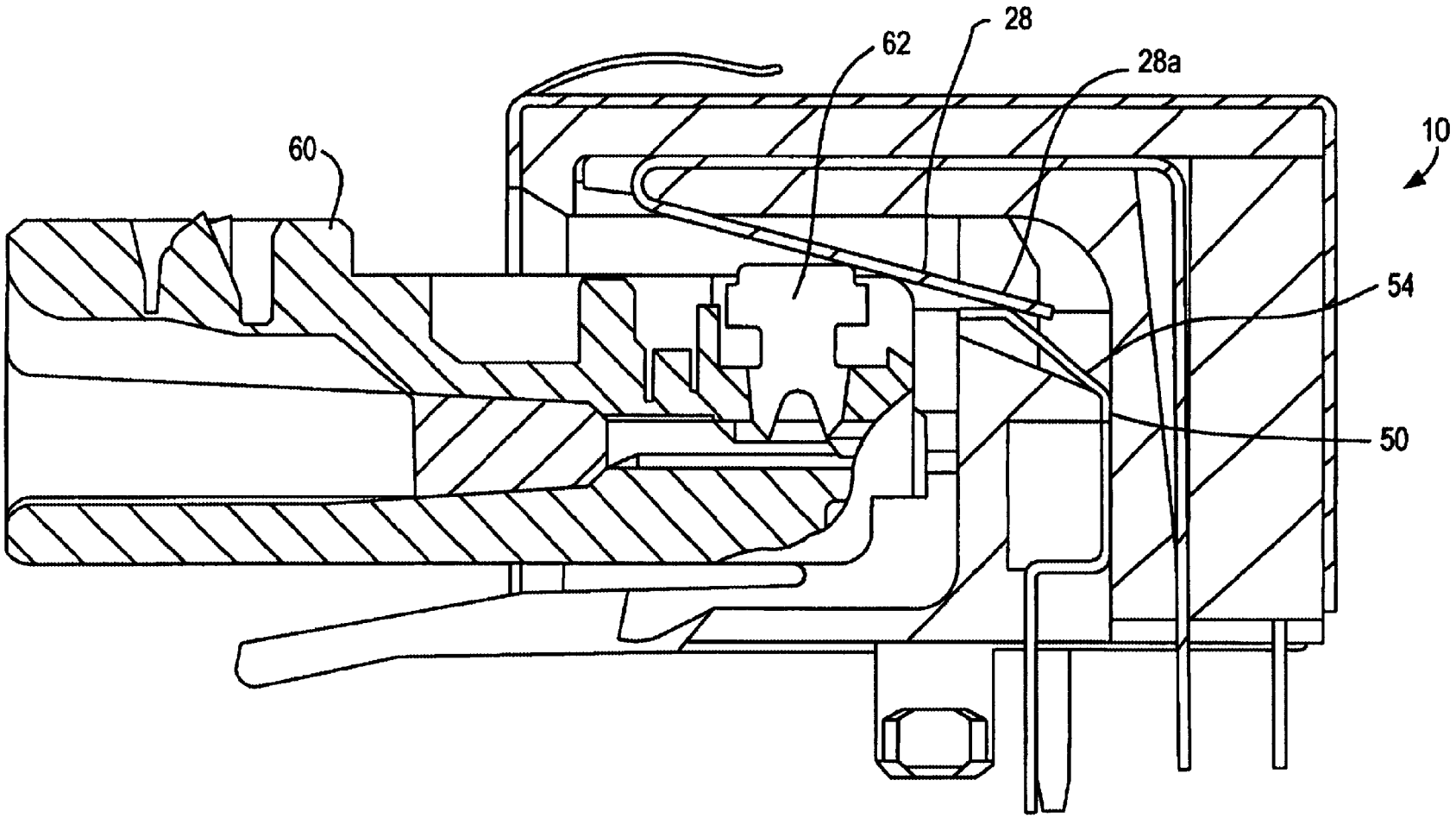
FIG. 5 is a broken-away view of a modular electrical connector assembly in accordance with the invention being used in conjunction with a modular plug.
Figure 6:
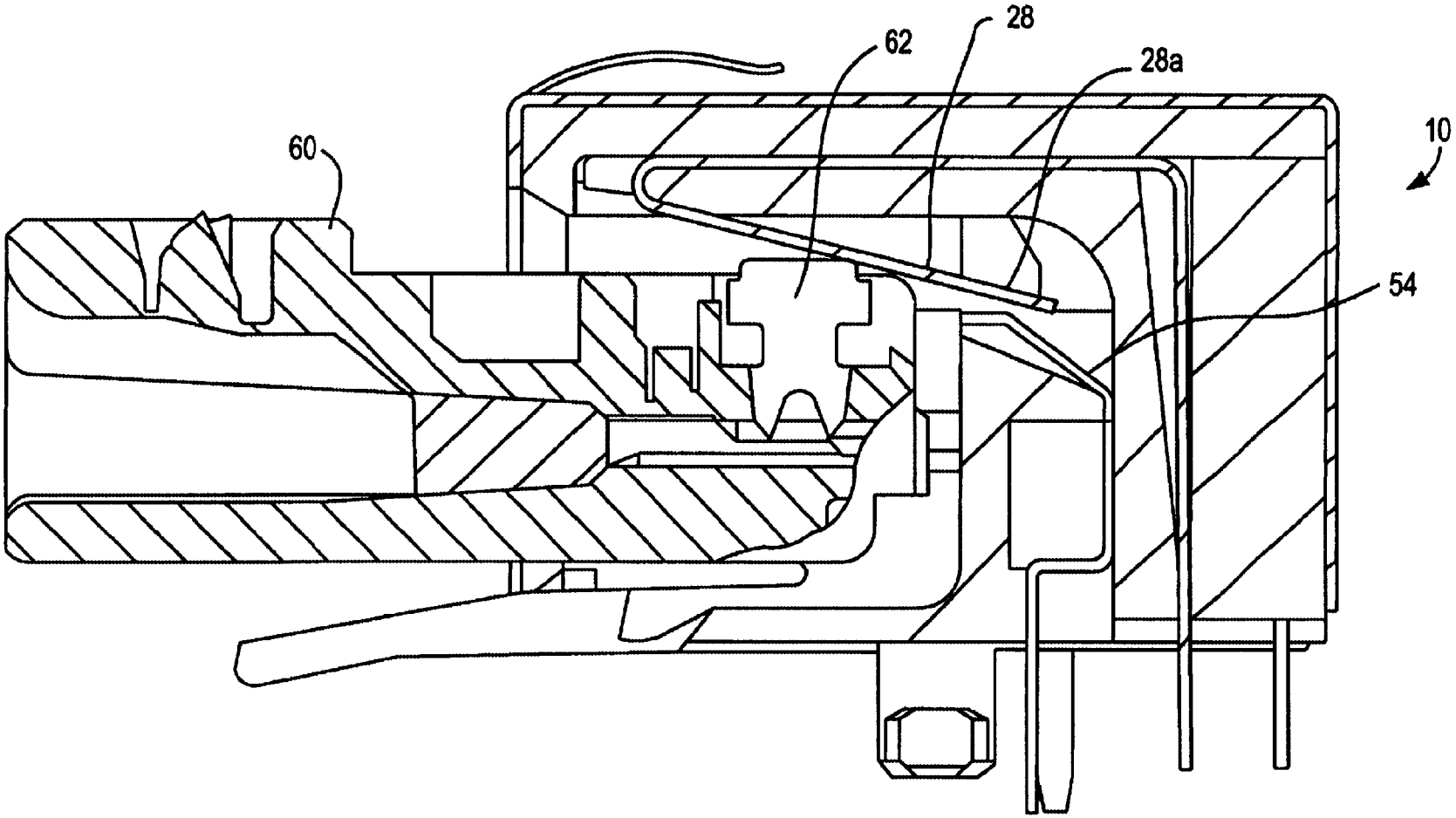
FIG. 6 is a broken-away view of a modular electrical connector assembly in accordance with the invention being used in conjunction with a modular plug.

In use, prior to the insertion of a mating plug into receptacle 20, the end portions 28*a* of the contacts 28 engage the fingers 54 of shorting bar 50 (as shown in FIG. 4). As shown in FIG. 5, plug 60 is inserted into the receptacle 20, plug terminals 62 electrically engage the contacts 28. During this period of the insertion, end portions 28*a* of the contacts 28 remain electrically engaged with fingers 54 of shorting bar 50. Any static charge built up in the cable to which the plug is connected is carried away as such charge is transmitted from terminals 62 through the contacts 28 to the shorting bar 50, via fingers 54, and from shorting bar 50 to the ground, via grounding projection 52, on the printed circuit board on which the connector assembly 10 is mounted. After complete insertion of plug 60 into receptacle 20 (mating) (FIG. 6), the end portions 28*a* of contacts 28 are urged out of contact with fingers 54 and the shorting bar 50 does not affect data transmission between plug 60 and connector assembly 10. Between the period of insertion where plug terminals 62 first engage contacts 28 and complete insertion, fingers 54, being of a spring-like configuration, follow and remain in electrical contact with the end portions 28*a* of contacts 28 for a period of time until they are ultimately urged out of contact with contacts 28. This extended period of contact allows a more thorough dissipation of static charges to ground than might otherwise be available. Accordingly, using the connector assembly 10 in accordance with the invention, the static charge on the cable to which the plug is attached is discharged and eliminated and is therefore not transmitted to the circuitry on the printed circuit board on which the connector assembly is mounted.

Obviously, numerous modifications and variations of the present invention are possible in light of the above teachings. Accordingly, it is understood that other embodiments of the invention are possible in the light of the above teachings. For example, although the outer housing part 16 is provided with a cylindrical channel to accommodate a cylindrical shorting bar, other shapes and forms of a channel and a shorting bar positionable therein are contemplated to be within the scope of the invention. Also, the shorting bar may take the form of one or more electrically connected elements and other means for establishing a path from the contact(s) or shorting bar to ground can be provided which do not require electrical conveyance through a shield.

Further, the shorting bar in accordance with the invention can be used in numerous different types of jacks and connector assemblies and is not limited to the particular construction of the jack, i.e., including an inner housing part and an outer housing part, shown in FIGS. 1 and 2. Rather, connector assemblies in accordance with the invention may include, in addition to a shorting bar engaging with the end portions of the contacts, either a plurality of contact/terminal wires (each having a contact portion situated in the plug-receiving receptacle and a terminal portion adapted for attached to the substrate on which the connector assembly is mounted) or for example, a first set of contacts including the contact portion and being attached to an internal printed circuit board and a second set of contacts including the terminal portion and also being attached to the internal printed circuit board. In this regard, reference is made to U.S. Pat. No. 5,736,910 (assigned to the current assignee and incorporated by reference herein in its entirety). The first and second set of contacts and internal printed circuit board would thus constitute transmission means for transmitting data from the plug to the substrate. Furthermore, the shorting bar in accordance with the invention can be incorporated into multi-port and multi-level modular connectors.

We claim:

1. An electrical connector assembly adapted to be mounted on a printed circuit board having a ground region, comprising:

a jack defining a plug receiving receptacle;

at least one contact at least partially situated in said plug receiving receptacle, the electrical connector assembly having an unmated state during which a plug, having at least one terminal, is only partially inserted into said plug receiving receptacle, the terminal being in electrical engagement with said at least one contact, and a mated state during which the plug is completely inserted into said plug receptacle, the terminal still being in electrical engagement with said at least one contact; and a shorting bar mounted at least partially within said jack, wherein said at least one contact is electrically coupled to said shorting bar when the connector assembly is in its unmated state and wherein said at least one contact is not electrically coupled to said shorting bar when the connector assembly is in its mated state, such that when the connector assembly is in its unmated state, any static charge of the plug being inserted into said plug receiving receptacle is transmitted through said ad least one contact to said shorting bar and from said shorting bar to the ground region on the printed circuit board.

2. The electrical connector assembly of claim 1, wherein said shorting bar comprises:

a grounding projection adapted to be connected to the ground region of the printed board, and at least one finger adapted to engage said at least one contact when the connector assembly is in its unmated state.

3. The electrical connector assembly of claim 2, wherein said jack comprises an outer housing part and an inner housing part situated in engagement with and at lest partially within said outer housing part to define the plug receiving receptacle, said outer housing part comprising a comb portion having at least one slot formed therein for receiving said at least one contact and said at least one finger of said shorting bar.

4. The electrical connector assembly of claim 1, further comprising a shield surrounding at least a portion of said jack and being electrically coupled to said shorting bar, said shield being electrically coupled to the ground region of the printed circuit board such that when the connector assembly is in its unmated state, any static charge of the plug being inserted into said plug receiving receptacle is transmitted through said at least one contact to said shorting bar find from said shorting bar to said shield and from said shield to the ground region on the printed circuit board.

5. The electrical connector assembly of claim 4, wherein said shorting bar comprises:

a grounding projection adapted to electrically engage said shield, and at least one finger adapted to engage said at least one contact when the connector assembly is in its unmated state.

6. The electrical connector assembly of claim 4, wherein said shorting bar comprises a connector pin being electrically connected to said shield.

7. The electrical connector assembly of clam 4, wherein said jack comprises an outer housing part having side walls and an inner housing part situated in engagement with and at least partially within said outer housing part to define said plug receiving receptacle, said outer housing part comprising a comb portion for receiving said at least one contact, said comb portion having a channel formed therein and at least one side wall of said outer housing part having an aperture formed therein in alignment with the channel of said comb portion, said shorting bar being arranged in the channel and extending through the aperture in said side wall of said outer housing and into electrical contact with said shield.

8. The electrical connector assembly of claim 7, wherein said comb portion comprises a plurality of slots, each slot being receivable of one of said at least one contacts, and wherein the channel is open over at least a radial portion thereof to communicate with said slots such that said contacts engage said shorting bar.

* * * * *